United States Patent [19]

Hancock et al.

[11] Patent Number: 4,859,376

[45] Date of Patent: Aug. 22, 1989

[54] GAS-DRIVEN CARBONATOR AND METHOD

[75] Inventors: Mark W. Hancock; Marvin M. May, both of Los Angeles, Calif.

[73] Assignee: Aquatec, Hollywood, Calif.

[21] Appl. No.: 67,803

[22] Filed: Jun. 26, 1987

[51] Int. Cl.[4] ..... B01F 3/04

[52] U.S. Cl. ..... 261/35; 261/82; 261/DIG. 7; 261/140.1; 261/DIG. 75; 261/84

[58] Field of Search ..... 261/35, 82, DIG. 7, 261/140.1, DIG. 75, 84

[56] References Cited

U.S. PATENT DOCUMENTS

| | | | |
|---|---|---|---|
| Re. 27,274 | 1/1972 | Mattingly | 128/66 |
| 27,775 | 4/1860 | Chamberlain . | |
| 780,714 | 1/1905 | Ferry | 261/113 |
| 1,115,980 | 11/1914 | Sleeper | 261/113 |
| 1,126,662 | 1/1915 | Stuhler | 261/35 |
| 1,872,462 | 8/1932 | Johnson et al. . | |
| 2,183,561 | 12/1939 | Hamblin | 261/DIG. 26 |
| 2,391,003 | 12/1945 | Bowman | 261/93 |
| 2,560,526 | 7/1951 | Thompson | 261/26 |
| 2,588,677 | 3/1952 | Welty et al. | 261/27 |
| 2,604,310 | 7/1952 | Brown | 261/35 |
| 2,674,263 | 4/1954 | Rupp et al. | 137/604 |
| 2,708,533 | 5/1955 | Nicholas | 222/146 |
| 2,735,370 | 2/1956 | Lance | 103/118 |
| 2,735,665 | 2/1956 | Lance | 261/27 |
| 2,750,076 | 6/1956 | Welty et al. | 222/129.1 |
| 2,798,135 | 7/1957 | Graham | 200/152 |
| 2,823,833 | 2/1958 | Banerlein | 261/DIG. 7 |
| 2,894,377 | 7/1959 | Shikles, Jr. et al. | 261/DIG. 7 |
| 2,988,343 | 6/1961 | Edwards et al. | 261/84 |
| 3,199,738 | 8/1965 | Cary et al. | 222/129.2 |
| 3,225,965 | 12/1965 | Jacobs et al. | 222/129.1 |
| 3,292,822 | 12/1966 | Crowder et al. | 222/129.1 |
| 3,382,897 | 5/1968 | Skiera et al. | 141/107 |
| 3,397,870 | 8/1968 | McCann et al. | 261/19 |
| 3,408,053 | 10/1968 | Vantroba | 261/27 |
| 3,495,803 | 2/1970 | Schoepe et al. | 251/25 |
| 3,618,905 | 11/1971 | Primue | 261/153 |
| 3,726,102 | 4/1973 | Parks | 62/70 |
| 3,756,473 | 9/1973 | Donahue, Jr. | 222/129.2 |
| 3,756,576 | 9/1973 | Tremolada | 261/35 |
| 3,761,066 | 9/1973 | Wheeler | 261/DIG. 7 |
| 3,809,292 | 5/1974 | Booth et al. | 222/146 |
| 3,926,102 | 12/1975 | De Lepeieire | 98/102 |
| 3,926,342 | 12/1975 | Selvia et al. | 222/129.1 |
| 4,068,010 | 1/1978 | Karr | 426/477 |
| 4,093,681 | 6/1978 | Castillo et al. | 261/122 |
| 4,108,167 | 8/1978 | Hickman et al. | 128/66 |
| 4,148,334 | 4/1979 | Richards | 261/140.1 |
| 4,173,178 | 11/1979 | Wieland | 261/DIG. 75 |
| 4,205,599 | 6/1980 | Franzosi et al. | 261/18 B |
| 4,216,885 | 8/1980 | Sedam | 222/481 |
| 4,222,825 | 9/1980 | Eisden | 203/11 |
| 4,225,537 | 9/1980 | Martonffy | 261/70 |
| 4,229,634 | 10/1980 | Hickman et al. | 200/302 |
| 4,242,061 | 12/1980 | Hartley | 417/536 |
| 4,302,186 | 11/1981 | Cammack et al. | 433/80 |
| 4,304,736 | 12/1981 | McMillin et al. | 261/35 |
| 4,316,409 | 2/1982 | Adams et al. | 99/275 |
| 4,359,432 | 11/1982 | Sedam et al. | 261/26 |
| 4,401,607 | 8/1983 | Child et al. | 261/121 |
| 4,422,371 | 12/1983 | Child et al. | 99/323.1 |
| 4,440,318 | 4/1984 | Berger | 222/129.1 |
| 4,466,342 | 8/1984 | Basile et al. | 99/323.1 |
| 4,475,448 | 10/1984 | Shoaf et al. | 99/323.1 |
| 4,509,569 | 4/1985 | Adolfsson | 141/360 |
| 4,518,541 | 5/1985 | Harris | 261/27 |
| 4,564,483 | 1/1986 | Jeans | 261/64 |
| 4,597,509 | 7/1986 | Pereira | 222/129 |
| 4,632,275 | 12/1986 | Parks | 222/25 |
| 4,635,824 | 1/1987 | Gaunt et al. | 222/129.1 |
| 4,655,124 | 4/1987 | Child | 99/323.2 |
| 4,659,520 | 4/1987 | Tarver | 261/82 |

*Primary Examiner*—Tim Miles

*Attorney, Agent, or Firm*—A. C. Smith

[57] ABSTRACT

An improved carbonator and method is disclosed which delivers water under pressure to a carbonator from a pump driven by the carbonating gas under pressure, the exhaust from which is mixed with the water being carbonated. Alternative embodiments are disclosed which are configured in unitary, low-cost, compact configuration conducive to cooling within confined compartments. Low operating pressures permit convenient use of inexpensive plastic components for efficient operation.

10 Claims, 4 Drawing Sheets

GAS-DRIVEN CARBONATOR AND METHOD

RELATED CASES

The subject matter of this application is related to the subject matter in pending application Ser. No. 068,018, entitled "Low Pressure, High Efficiency Carbonator", filed on June 26, 1987 by Mark W. Hancock and Marvin M. May, and to the subject matter in pending application Ser. No. 068,017, entitled "Improved Drink Dispenser and Method of Preparation", filed on June 26, 1987 by Mark W. Hancock and Marvin M. May, which are incorporated herein by reference.

BACKGROUND OF THE INVENTION

Field of the Invention

This invention relates to carbonators and more particularly to in-line carbonators including gas-driven water pumping means that delivers water under pressure to the in-line carbonator for mixing therein with carbon-dioxide gas exhausted from the gas-driven pumping means.

Certain known carbonators use piston pumps to deliver water under pressure to a carbonator tank which contains an atmosphere of carbon dioxide gas. While such pumps are commonly motor driven, other such pumps are known to be actuated by carbon dioxide gas under pressure, and the gas exhausted from the pump is then dissolved in the water delivered under pressure by the pump. Devices of this type are described in the literature (see, for example, U.S. Patents 4,304,736 and 3,756,576 and 4,518,541). Devices of these types rely upon a pressure vessel to store a volume of water in an atmosphere of carbon dioxide in order to promote the solution of the gas in the volume of water. In certain carbonators particularly suited for home consumer applications, it is desirable to reduce the costs and bulk associated with pressure vessels and electric motor driven pumps. One scheme for eliminating the bulk of pressure vessels is to continually combine carbon dioxide gas with water in an on-line device as carbonated water is dispensed. Devices of this type are also described in the literature (see, for example, U.S. Patent 3,761,066).

Many of the aforected prior art devices are configured for commercial applications where size, cost, carbonating efficiency, and the like, may not be primary design considerations. For example, in the aforementioned U.S. Patent 4,304,736, inlet water first passes through a turbulator 43 and then into a pressure-vessel type of carbonator 12. There, the turbulator is reported to provide some substantial benefits degassifying the inlet water.

However, this carbonator with its inlet precarbonator/turbulator 43 appears to provide no substantial advantage in having the dissolved atmospheric gasses separated and in gaseous form upon entering the carbonator 12. These atmospheric gasses would normally come out of solution anyway during efficient carbonation in carbonator 12. Either with or without the turbulator 43, the partial pressures of the gasses present would equilibrate within the vented carbonator vessel and would be substantially swept away in either case by any excess carbonating gas provided. Also, such turbulator 43 as a precarbonator does not appear to provide sufficient carbonator efficiency alone to use without the carbonator vessel. In addition, the configuration of components in the carbonator system described in this patent is not conducive to convenient fabrication in a single, compact, low-cost unit suitable for applications such as in home refrigerators since only some components are cooled and others are segregated and not cooled.

In certain carbonator applications, for example, for disposition within a refrigerator or for submersion in a reservoir of cooled water, it is desirable to eliminate electrical components and extraneous electrical wiring. Thus, it is desirable to eliminate electrical valves and control switches in such applications without compromising versatile carbonator operation. Carbonators having various features which may be considered pertinent to the present invention are also described in the literature (see, for example, the U.S. patent references cited herein).

SUMMARY OF THE INVENTION

Accordingly, it is an object of the present invention to provide a compact, low-cost in-line carbonator system and method which includes a gas-driven water pump for high-efficiency carbonation.

It is another object of the present invention to provide a carbonator system and method in which a gas-driven pump supplies water under pressure to a carbonator that carbonates the pressurized water using carbon dioxide gas exhausted from the pump.

It is another object of the present invention to provide an improved carbonator system and method which obviates the cost and bulk of pressure vessels and separate carbonator components.

In accordance with the present invention, an in-line carbonator is formed within a common housing including a gas-driven water pump that operates on pressurized carbon dioxide gas to deliver water under pressure to the in-line carbonator on demand, and wherein the exhausted gas from the pump is then dissolved in the water under pressure. Carbonated water can be selectively dispensed directly from the in-line carbonator on a continuous basis without need for a bulky, pressurized storage vessel. The pump and carbonator contained within a compact housing can be conveniently cooled for example, by submission in cooled water or by positioning within a small compartment of a home refrigerator for low-cost, efficient operation.

DESCRIPTION OF THE PREFERRED EMBODIMENT

Figure 1:
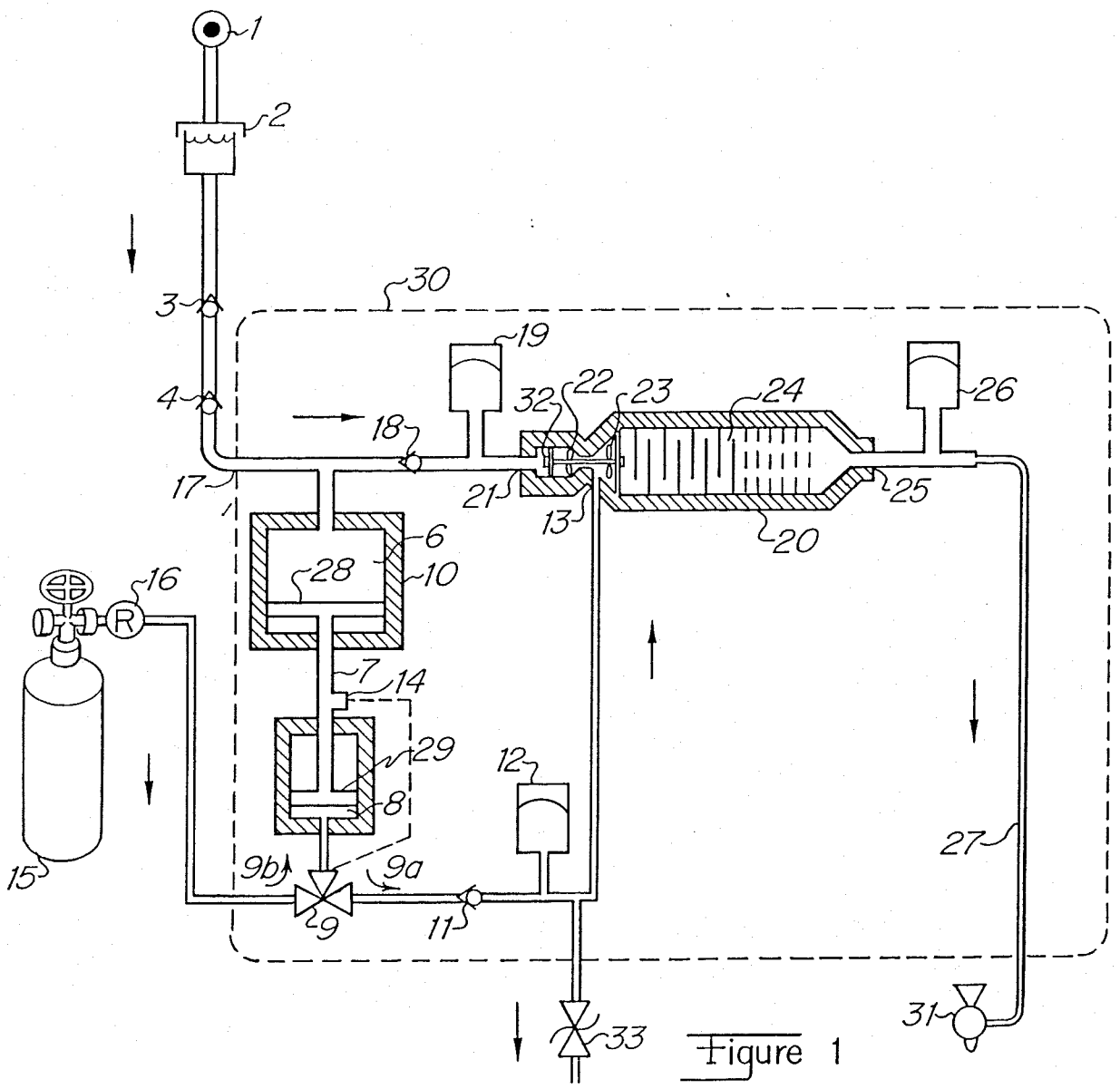
FIG. 1 is a schematic diagram of one embodiment of the present invention including a gas-driven water pump.

Referring now to FIG. 1, there is shown a schematic diagram of one embodiment of the carbonator apparatus of the present invention in which the pump 10 and carbonator 20 components are contained within a common housing 30. Specifically, a supply of water under pressure 1 is connected through an anti-siphon valve 2 and check-valves 3, 4 (optional, for municipal water systems) to an inlet 17 of the housing 30. The inlet water is supplied to chamber 6 including piston (or diaphragm) 28 which is disposed to alter the volume of the chamber as a function of the position of piston 28. The inlet water is also connected through check valve 18 and accumulator 19 (e.g., a pressure head) to the water inlet 21 of carbonator 20. The piston 28 in chamber 6 is mechanically linked to piston 29 (or diaphragm) in chamber 8 which is connected via control valve 9 having valve pathways 9*a*, 9*b* to a supply 15 of carbon dioxide gas at an available line pressure controlled by regulator 16. The gas outlet from pathways 9*a*, 9*b* are coupled through check valve 11 to a gas accumulator 12 and to the gas inlet 13 of carbonator 20. A relief valve 33 is also connected to the accumulator 12 and gas inlet 13 to vent gas in excess of a selected gas pressure. The outlet 25 of the carbonator 20 is connected to an accumulator or pulsation control 26 (optional) and through a choke line 27 to the manual dispenser valve 31.

In operation, inlet water or other liquid from the source 1 is supplied at a pressure of about 35–75 psi, and is precooled (not shown). The water enters the chamber 6 through the valves 2, 3, 4 and displaces the piston 28 therein which, in turn, displaces the piston 29 in chamber 8 to expell the gas in chamber 8 through outlet pathway 9*a* of valve 9. This gas under pressure flows through to the check valve 11 to the accumulator 12 and carbonator inlet 13. The gas inlet 13 may be equipped with a restrictor nozzle or other means (not shown) to regulate the flow of gas into the carbonator 20.

When the piston 28 reaches maximum displacement in its stroke, control lug 14 on the connecting rod 7 is disposed to toggle the control valve 9 to close outlet pathway 9*a* and open inlet pathway 9*b* to admit gas under pressure (about 200 psi, as controlled by regulator 16) into chamber 8. Ideally, such valving should occur rapidly to avoid an intermediate valve position when random dispensing stops operation at the transition condition. As chamber 8 pressurizes, the piston 29 displaces which, through connecting rod 7, also displaces piston 28 in chamber 6 to expell water from the chamber 6. Check valves 3, 4 inhibit flow back toward the precooled supply 1 of inlet water and, instead, flows through check valve 18 into accumulator 19 and inlet 21 of the carbonator 20. This piston displacement continues to the maximum position at which control lug 14 on piston rod 7 is disposed to toggle the control valve 9 for repeat operation as previously described. In applications where water supply 1 has insufficient water pressure, a spring (not shown) may be coupled to the piston assembly 28, 7, 29 to urge the piston 28 toward its position of maximum volume in chamber 6.

The effective area of the piston 28 in chamber 6 is selected to be larger than the effective area of the piston 29 in chamber 8 by the ratio slightly less than the ratios of water pressure to gas pressure in the respective chambers 6, 8, or about 2.5:1 for inlet water at 80 psi. In the water-driven reciprocated phase of the pumping cycle, water under pressure in chamber 6 thus creates a gas pressure in chamber 8 about 2.5 times greater than the inlet water pressure. Thus, for the anticipated range of water pressures (35–75 psi), the range of pressures in the chamber 8 is approximately 87.5 to 187.5 psi, which is more than required to inject carbon dioxide gas into the carbonator 30 against the pressure of water flowing therein. The gas-to-water metering ratio is effectively controlled by the relative chamber sizes 6, 8 (fixed, as manufactured) and by the line pressure selected via regulator 16. However, the throughput can be expected to decrease as the inlet water pressure increases.

At a setting of about 200 psi line pressure, and a ratio of piston areas of about 2.5:1, it can be shown that approximately 5.84 atmospheres of carbon dioxide will be delivered for each volume of water delivered. If all such carbon dioxide could be dissolved under ideal conditions, a carbonation strength of 5.8 "volumes" would result. Since all such carbon dioxide gas is not likely to be dissolved per volume of water delivered, excess gas may be vented through relief valve 33, which may be adjustable, to adjust the amount of remaining undissolved gas that is available as tiny bubbles of undissolved gas through the dispensing valve 31.

The in-line carbonator 20 includes a tapered passageway 32 which creates a flow-restricting nozzle that accelerates the velocity of water flowing therethrough past the gas inlet 13 and into the downstream expanded passageway 24. This venturi-type structure may include rotatable propellers-choppers 22, 23 mounted in the tapered passageway 32 to increase the surface area of the water before and after introduction of carbon dioxide gas through gas inlet 13. The gas and water flows into the expanded portion 23 of the chamber and through outlet 25 to the accumulator 26 and through choke line 27 to dispensing valve. The choke line 27 slows the flow and provides back pressure for the Venturi-type carbonator. The accumulators 12, 19, and 26 may be added to dampen pulsating flow attributable to the pump 10. In an alternate configuration, the relief valve 33 may be coupled to the gas space in accumulator 26 to selectively vent excessive fluid pressure and accumulated atmospheric gasses.

The working components of the carbonator according to this embodiment are all incorporated into a common housing 30 which may be formed of thermoplastic material in suitable shape to position within an ice tray, or other cooling environment.

Figure 2:
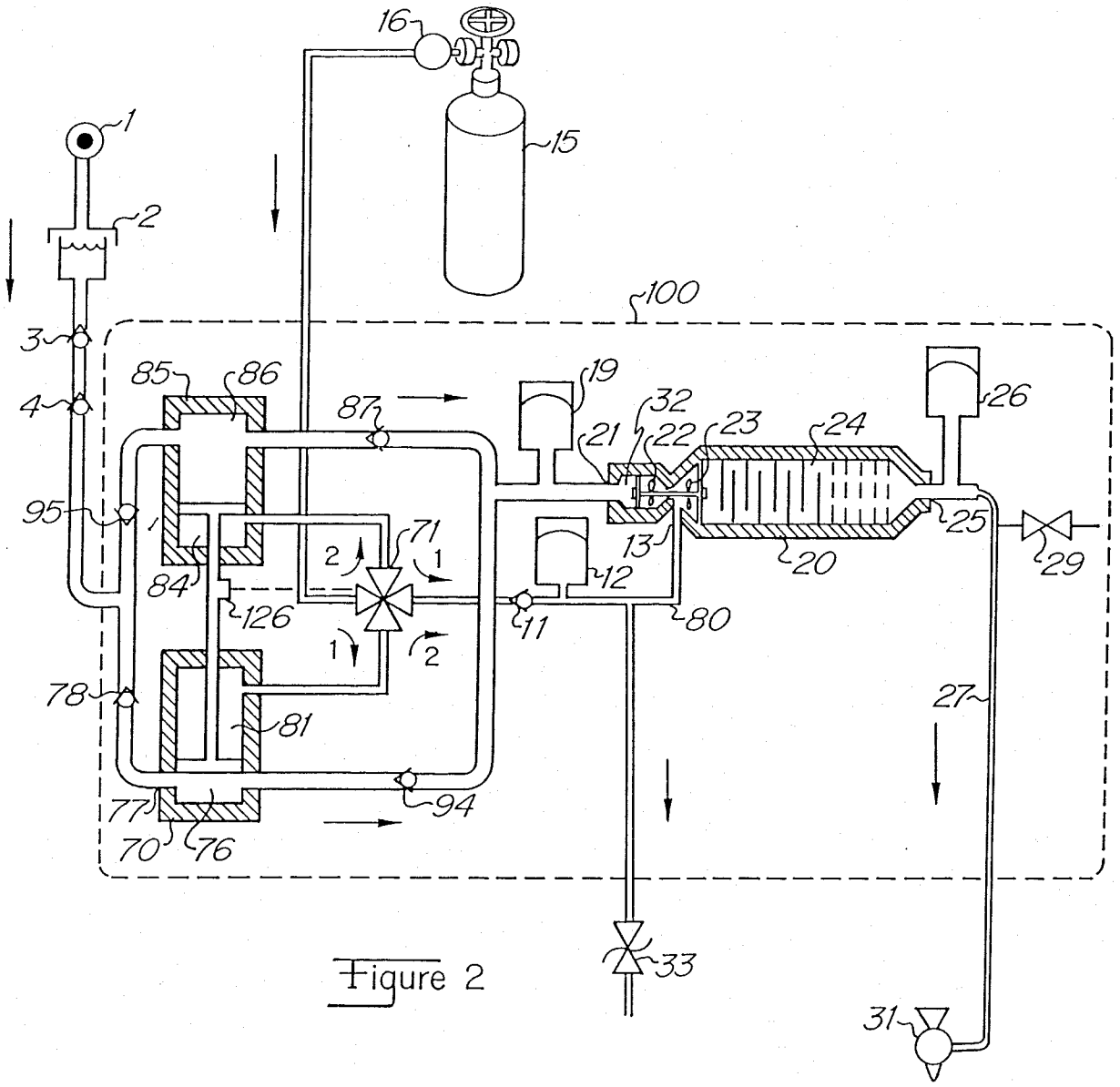
FIG. 2 is a schematic diagram of another embodiment of the present invention including a double-acting gas-driven water pump.

Referring now to FIG. 2, there is shown a schematic diagram of another embodiment of the present invention in which a double-action piston pump is used to supply water under pressure to the Venturi-type carbonator, independently of supply water pressure. In this embodiment, the pumping means interposed between the water inlet 17 and water inlet 21 of carbonator 20, and between gas inlet at regulator 16 and the gas inlet 13 of carbonator 20 is modified to include a pair of double-acting piston chambers 70 and 85. The pistons (or diaphragms) are linked together by a connecting rod which includes control lug 126 that is disposed to activate the control valves 71, and each piston and chamber includes separated gas and water chambers. Specifically, inlet water is supplied through check valves 95, 78 to the respective water chambers 86, 76 and outlet water from each of the chambers 86, 76 is delivered through check valves 87, 94 to the water inlet of the carbonator. Similarly, the carbon dioxide gas 15, at line pressure selected by the regulator 16, is supplied through directional control valves 71 to the gas chamber 84, 81 on opposite sides of the pistons from the water chambers 86, 76.

In operation, water is supplied (or drawn in) through check valve 95 to water chamber 86 as the piston displaces toward maximum chamber volume in response to pressurized gas being supplied through valves 71 to the gas chamber 81. This same piston stroke delivers water from chamber 76 through check valve 94 to the water inlet 21 of the carbonator 20, and delivers gas from gas chamber 84 through valves 71 and check valve 11 to the gas inlet 13 of the carbonator 20.

When this piston stroke is completed, the control lug 126 is disposed to rapidly toggle the control valve to the alternate condition of gas flow into gas chamber 84 and out of chamber 84. This causes the piston stroke to reverse for delivering water out of chamber 86 through the check valve 87 to the water inlet 21 of the carbonator, and forcing gas out of chamber 81 through valves 71 and check valve 11 to the gas inlet 13 of the carbonator 20. Upon completion of the reverse stroke, the control lug 126 again toggles the control valves 71 to the initial condition, and so on, for continuous operation in the manner described as carbonated water is selectively dispensed through dispenser valve 31. This embodiment of the present invention therefore does not rely upon supply water pressure to reciprocate the pumping cycle, as in the embodiment illustrated in FIG. 1, and is therefore more universally suitable for applications in which water is supplied with a wide range of pressures.

Figure 3:
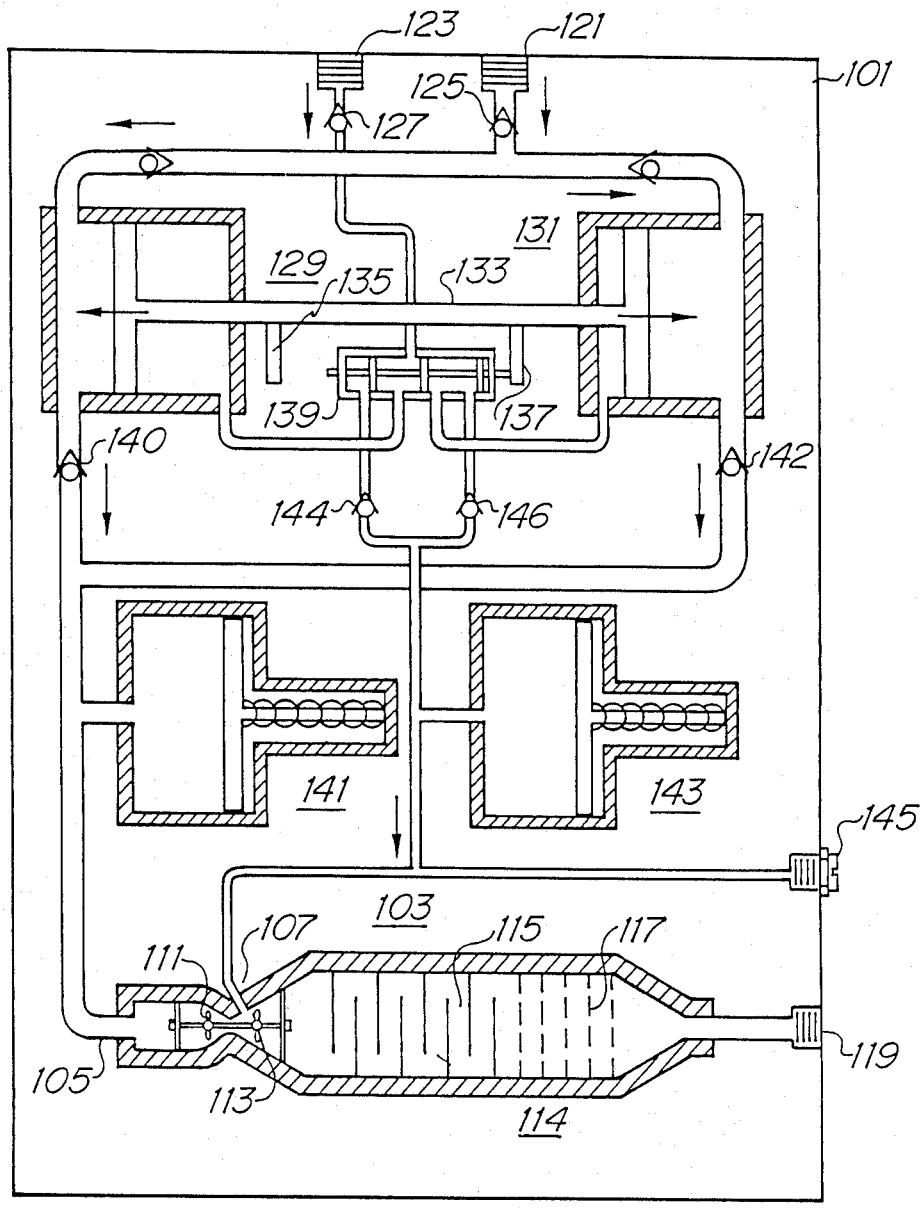
FIG. 3 is a pictorial diagram of an embodiment of the present invention configured within a common housing.

Referring now to FIG. 3, there is shown a pictorial diagram of an improved embodiment of the present invention that is formed within a common housing 101. The carbonator 103 includes a water inlet 105 and a gas inlet 107 at a location downstream from the water inlet 105 and from restrictor section 109 at which increased water velocity creates a reduction in pressure (i.e. Venturi). Rotatable propeller-choppers 111, 113 may be disposed upstream and downstream of the restrictor section 109 to break up and mix the flowing fluids. The expanded section 114 includes a series of baffles 115 and fine screens 117 shown schematically to promote formation of minute bubbles of undissolved gasses that can flow with the carbonated water as a water/gas slurry. External outlet connector 119 may be connected via a choke line (not shown) to a manual dispenser valve. Such choke line provides backpressure for the Venturi-type carbonator and also slows the flow of carbonated water to retain gas in solution longer.

The water and gas under pressure required to operate the carbonator are coupled to the housing 101 at external inlet connectors 121 and 123, respectively. Internal check valves 125, 127 are connected to inhibit backflow of water or gas, respectively, to the supplies. A pair of double-acting, dual-chamber pumping chambers 129, 131 include sliding pistons (or diaphragms) which are linked together by connecting rod 133 that has valve-controlled lugs 135, 137 thereon for operating the control valve 139. The control lugs 135, 137 engage the valving member 141 near the end of the piston stroke in each direction to toggle the valve 139 into the alternate operating position to assure continued pumping operation in the manner more fully described above with reference to the embodiment illustrated in FIG. 2.

The water delivered under pressure from each of the chambers 129, 131 through check valves 140, 142 is supplied to the water inlet 105 of the carbonator and to the accumulator or pulsation control 141 (e.g. spring-loaded pressure head), and the exhaust gas flowing through the control valve 139 and check valves 144, 146 is delivered to the gas inlet 107 and to the accumulator or pulsation control 143. These internal accumulators are connected to the water and gas lines to smooth out the pulsating fluid flow from the pumping chambers 139, 131 and thereby minimize surges of concentrated carbonation downstream. Also, a relief valve 145 having external adjustment and venting provisions is connected to the gas inlet 107 of the carbonator to vent excessive gas pressure. Of course, other gas-driven fluid pumps, for example, having rotary, positive-displacement operating features may also be used in place of piston chambers to deliver water under pressure and exhaust gas to the carbonator.

In operation, carbon dioxide at a line pressure of about 90 psi (under control of a regulator) may be supplied to the external inlet connector 123 to operate the in-line carbonator efficiently on water pressures greater than about 30 psi. Since equal volumes of gas and water are metered by the reciprocating pistons in chambers 129, 131 (of equal effective areas), it can be shown that about 7.1 atmospheres of gas (i.e. $90/14.7+1$) will be delivered for each volume of water. Also, since only about 4.5 volumes of carbon dioxide gas need to be dissolved for good carbonation, the excess gas will be available at the external outlet connector 119 or, alternatively, may be vented from the gas inlet via adjustable relief valve 145. The "spitting" effect of excessive, undissolved gas dispensed with carbonated water may be reduced by a choke line and proper homogenizing of gas bubbles in carbonator 103. At these dispenser valve operating pressures, it is convenient to form the housing 101 and internal components of thermoplastic materials such as acrylics and polycarbonates When the carbonator of the present invention is provided with inlet fluid containing significant amounts of dissolved atmospheric gasses, and operated in a manner which passes the aforecited excess carbon dioxide through outlet connector 119, the effluent bubbles will contain partial pressures of atmospheric gases. The carbonator may, therefore, be equipped to vent such atmospheric gasses which come out of solution during the carbonation process. Such venting creates high carbonation levels for a given operating pressure. In addition to the aforecited dispensing of gas bubbles which effectively provides venting, the carbonator of the present invention may be equipped with gas venting means interposed between outlet 25 and dispensing valve 31 of FIG. 2. Such venting means 29 is depicted schematically in FIG. 2 and may include gas/liquid separators known in the art including valve-type separators and semi-permeable barrier materials.

The effect of venting depends on the amount of dissolved air in the inlet fluid, the operating pressure of the carbonator, the carbonation temperature, the carbonator efficiency, and the amount of gasses vented. The beneficial effect of venting a predetermined amount of gas mixture from the carbonator along with the equilibrium partial pressures of atmospheric gases in the carbonator effluent may be estimated for any given set of inlet fluid and operating conditions by use of mathematical models based on the application of Henry's law and the solubility curves of the gasses present.

Figure 4:
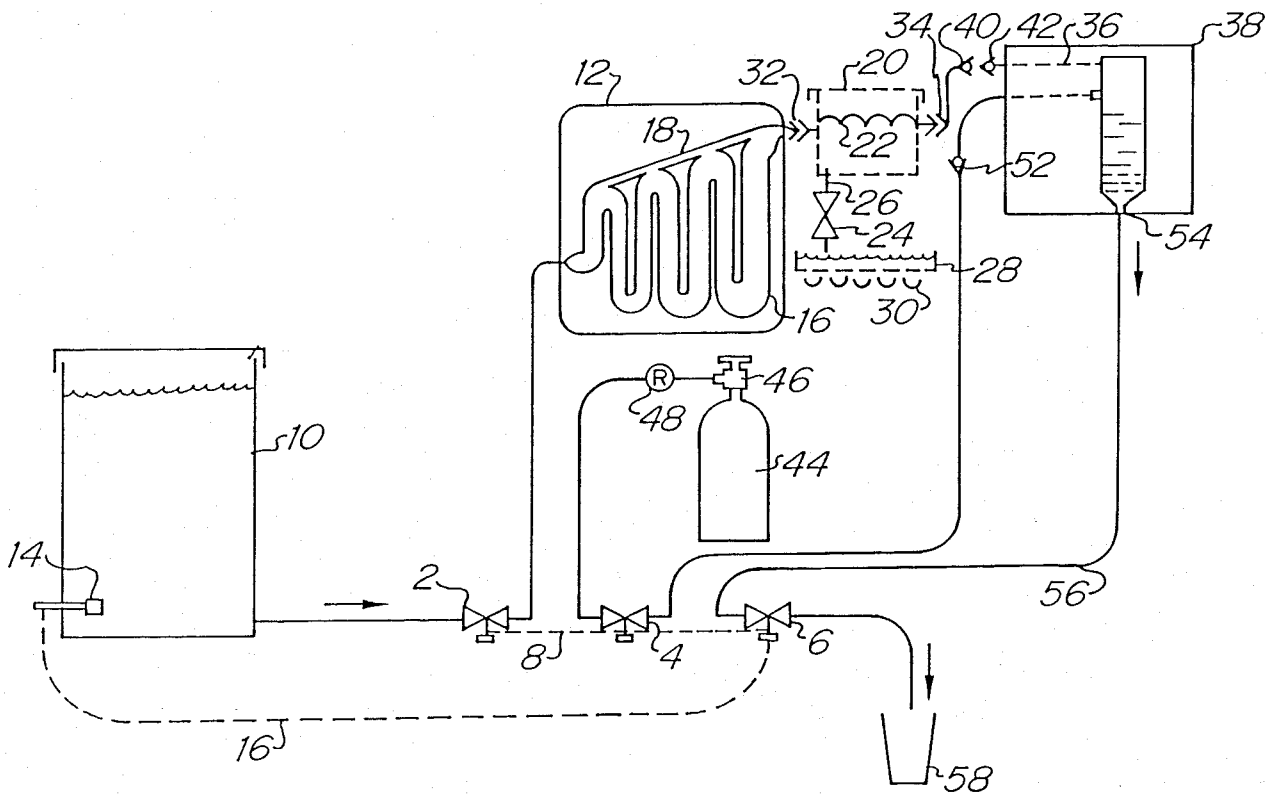
FIG. 4 is a schematic diagram of an in-line carbonator configured for installation in home refrigerators.

Referring now to FIG. 4, there is shown a schematic diagram of an in-line carbonator 38 and associated components disposed for installation, in a home refrigerator.

In this embodiment, valve 2 controls the flow of liquid, and valve 4 controls the flow of carbon dioxide into the carbonator. Dispense valve 6 controls the flow of carbonated water from the carbonator. All three valves 2, 4, 6 are operatively connected as indicated by dotted line 8 to be activated simultaneously when the dispensing valve 6 is actuated.

In operation with the reservoir dispensing valve 6 is activated, water from reservoir source 10 passes through water inlet valve 2 and subsequently into cooling container 12. Source 10 may be an open reservoir or a pressurized supply source, or it may also be a closed or pressurized container if desired. As shown in the drawing, source 10 is an open container equipped with liquid level sensing means 14 which is operatively connected, as shown by dotted line 16, to valve 2, and the operative connection is through dispense valve 6. When source 10 is pressurized, similary functional control can be achieved by a suitable pressure sensor 14.

Cooling container 12 is a plate-line device which in practice is about 1¼" thick and conveniently fits against an interior wall of a refrigerator, and includes a substantially continuous fluid channel 16 which encourages plug flow through the device, and may also include a bubble conduit 18 to encourage rapid passage of undissolved gasses to the outlet 32.

An optional cooling reservoir 20 may be installed in the system to increase the reserve of cooled water and thereby increase drink-making capacity. Alternatively, this reservoir may be used in place of cooling container 12. Thus, reservoir 20 is equipped with a cooling coil 22 which is disposed to be in thermal communication with ice placed into reservoir 20. Ice may be loaded into reservoir 20 either manually or automatically from an ice maker in the freezer section of a host refrigerator. Reservoir 20 is also provided with a drain so that liquid water may be removed. Drain valve 24 may be manual or automatic and the inlet to drain line 26 may be disposed as shown or elevated and higher in reservoir 20 to act as an overflow.

The end of drain line 26 may be so placed that liquid flow from reservoir 20 is conducted into the defrost pan 28 of the host refrigerator. Such pans are generally placed near condensing/heater coils 30 to promote rapid evaporation of liquid water which drains into the pan during defrosing operations. With contemporary, microprocessor-equipped refrigerators, management control of the carbonator system can be easily accomplished with appropriately-placed sensors. For example, control of ice delivery can be accomplished with a temperature or ice sensor placed in reservoir 20 or in contact with cooling coil 22. Ice delivery can be inhibited when defrost pan 28 becomes full as detected by an appropriate sensor.

An indicator light or message can further advise the consumer not to replace any ice in the cooling reservoir 20 while the defrost pan is full. Reservoir 20 is shown having optional quick-connect couplers 32 and 34 to facilitate easy removal for cleaning.

Cooling container 12 is therefore connected with the water inlet 36 of the carbonator 38. Inlet check valves 40 and 42 may be required by certain municipalities. Carbon dioxide from storage cylinder 44 passes though the isolation valve 46 and carbon-dioxide control valve 4 and check valve 52 to inlet 50 of the carbonator 38. If not provided internally in the crbonator 38, check valve 52 may be provided to prevent backflow of fluid into regulator 48. The carbonator 38 which may be of the gas-driven pump type previously described includes a carbonated water outlet 54 that is connected via choke line 56 to the dispense valve 6. The purpose of the choke line 56 has been described. Manual actuation of dispensing valve 6 also activates valves 4 and 2 allowing inlet water and gas into the carbonator while carbonated water flows out of the carbonator into beverage glass 58. Valve 6 may be equipped with means to provide swirling and mixing of syrup with the carbonated water being dispensed, as previously described in copending application Ser. No. 068,017, or, alternatively, may be integrated into a conventional post-mix syrup-dispensing system.

Therefore, the in-line carbonator of the present invention include a gas-driven water pump for compact, efficient operation at operating fluid pressures that are conducive to fabrication using inexpensive plastic components assembled within a unitary housing.

We claim:

1. Carbonator apparatus comprising:

fluid mixing means for combining liquid and gas therein including a conduit disposed to direct fluid flow therethrough between a liquid inlet and a fluid outlet and having a gas inlet coupled thereto at a location therealong intermediate the liquid inlet and fluid outlet;

pumping means for pumping liquid into the liquid inlet of the fluid mixing means in response to gas under pressure transferred through said pumping means said pumping means includes a plurality of variable-volume chambers coupled to operate in synchronized movement for admitting liquid into at least one of the variable-volume chambers to be expelled by gas under pressure admitted into another of the variable-volume chambers;

valve means coupled to respond to said movement for selectively controlling the exhausting of gas under pressure transferred through a selected one of the variable-volume chambers;

first source means coupled to supply liquid to the pumping means;

second source means of gas under pressure coupled to supply gas to the pumping means for pumping liquid into said liquid inlet;

means coupling the exhausted gas transferred through the pumping means to the gas inlet of said fluid mixing means; and dispensing valve means coupled to the fluid outlet of said fluid mixing means for selectively controlling the dispensing of liquid combined with gas from the fluid outlet of said fluid mixing means.

2. Carbonator apparatus according to claim 1 wherein the cross-sectional area of said other chamber is smaller than the cross-sectional area of said one chamber.

3. Carbonator apparatus as in claim 1 wherein:

said conduit in said fluid mixing means includes a Venturi conduit having an interior passage having a cross-sectional shape which tapers inwardly along a fluid path between said liquid inlet and said fluid outlet to an intermediate chamber along said axis, and having an outlet chamber of expanded cross-sectional dimension disposed along said fluid path between the intermediate chamber and said fluid outlet for reducing the fluid pressure at the gas inlet in inverse relationship to the rate of fluid flow through the intermediate chamber; and said gas inlet is coupled to said conduit near said intermediate chamber.

4. Carbonator apparatus as in claim 1 wherein:

said fluid mixing means and said pumping means are formed within a common housing having a thickness dimension which is subtantially smaller than the length or width dimensions thereof for storage within a compartment of reduced ambient temperature.

5. Carbonator apparatus as in claim 4 wherein:

said housing includes plastic material selected from the group consisting of acrylates and polycarbonates.

6. Carbonator apparatus as in claim 5 wherein:

said plastic material includes a layer of gas-impervious material to inhibit perfusion therethrough of gas in contact therewith.

7. Carbonator apparatus as in claim 6 wherein:

said layer includes polyvinylidine chloride.

8. The method of carbonating a liquid comprising the steps of:

pumping through a conduit for directing fluid flow from an inlet to an outlet the liquid to be carbonated in response to selective mechanical interaction with the carbonating gas under pressure;

increasing the velocity of the liquid moving through the conduit by reducing the cross-sectional dimension thereof at a selected location therealong;

introducing into the conduit at the selected location therealong the carbonating gas after the selective mechanical interaction with the liquid; and selectively dispensing the mixture of liquid and carbonating gas from the conduit at an outlet remote from said selected location.

9. The method as in claim 8 wherein the steps of pumping and introducing are performed at reduced operating temperature.

10. The method according to claim 8 comprising of step of:

combining within the conduit undissolved gas and liquid at a location therein intermediate the selected location and said remote location for passing the undissolved gas from the conduit during the step of dispensing.

* * * * *